US005476197A

United States Patent [19]

Lawrence et al.

[11] Patent Number: 5,476,197

[45] Date of Patent: Dec. 19, 1995

[54] SPOUT ASSEMBLY FOR FLUID DISPENSER

[75] Inventors: Andrew M. Lawrence, Mission Hills; Emmanuel A. Hanna, Lakeview Terrace, both of Calif.

[73] Assignee: Bobrick Washroom Equipment, Inc., North Hollywood, Calif.

[21] Appl. No.: 379,792

[22] Filed: Jan. 27, 1995

[51] Int. Cl.[6] ..... B67D 5/00

[52] U.S. Cl. ..... 222/321.7; 222/180; 222/571

[58] Field of Search ..... 222/173, 180, 222/321, 383, 385, 571, 321.1, 321.7, 321.9, 383.1; 239/587.5, 600

[56] References Cited

U.S. PATENT DOCUMENTS

| | | | |
|---|---|---|---|
| 923,447 | 6/1909 | Schmidt | 222/180 |
| 1,229,556 | 6/1917 | Watrous | 222/180 |
| 1,290,435 | 1/1919 | Watrous | 222/180 |
| 1,522,370 | 1/1925 | Jenney | 222/321 |
| 2,294,236 | 8/1942 | Levernier | 222/180 X |
| 2,521,164 | 9/1950 | Hayes | 222/321 |
| 2,681,622 | 6/1954 | Titus | 222/321 X |
| 2,772,116 | 11/1956 | Dobkin | 222/383 X |
| 5,332,129 | 7/1994 | Brattoli et al. | 222/321 |

*Primary Examiner*—Kevin P. Shaver

*Attorney, Agent, or Firm*—Harris, Wallen, MacDermott & Tinsley

[57] ABSTRACT

A fluid dispenser having a fluid container, a spout, and a pump for pumping fluid from the container out to the spout and having a piston for moving vertically along a piston axis. The spout has an inner end connected to the piston through a piston cap, with downward pressure on the piston cap moving the piston downward and actuating the pump. The spout also has a center section, an outer end with an outer bend, and an inner end with an inner bend, the piston has an upper end, and the spout inner end and the piston upper end have interengaging threaded portions coaxial with the piston axis. The piston cap has a body with a central opening coaxial with the piston axis and a lateral opening connecting with the central opening for receiving the spout, with the piston cap rotatable with the spout as the spout inner end is threaded into the piston upper end.

6 Claims, 1 Drawing Sheet

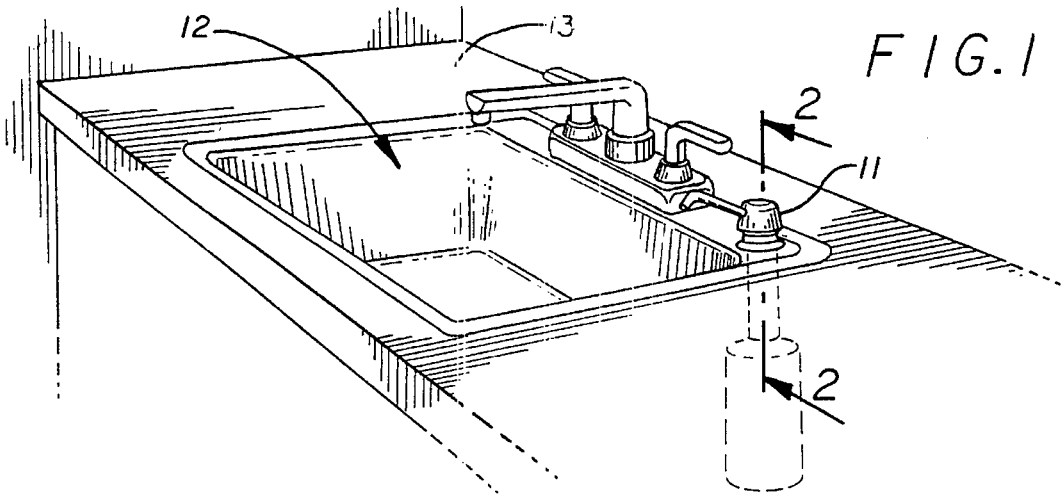
FIG. 1
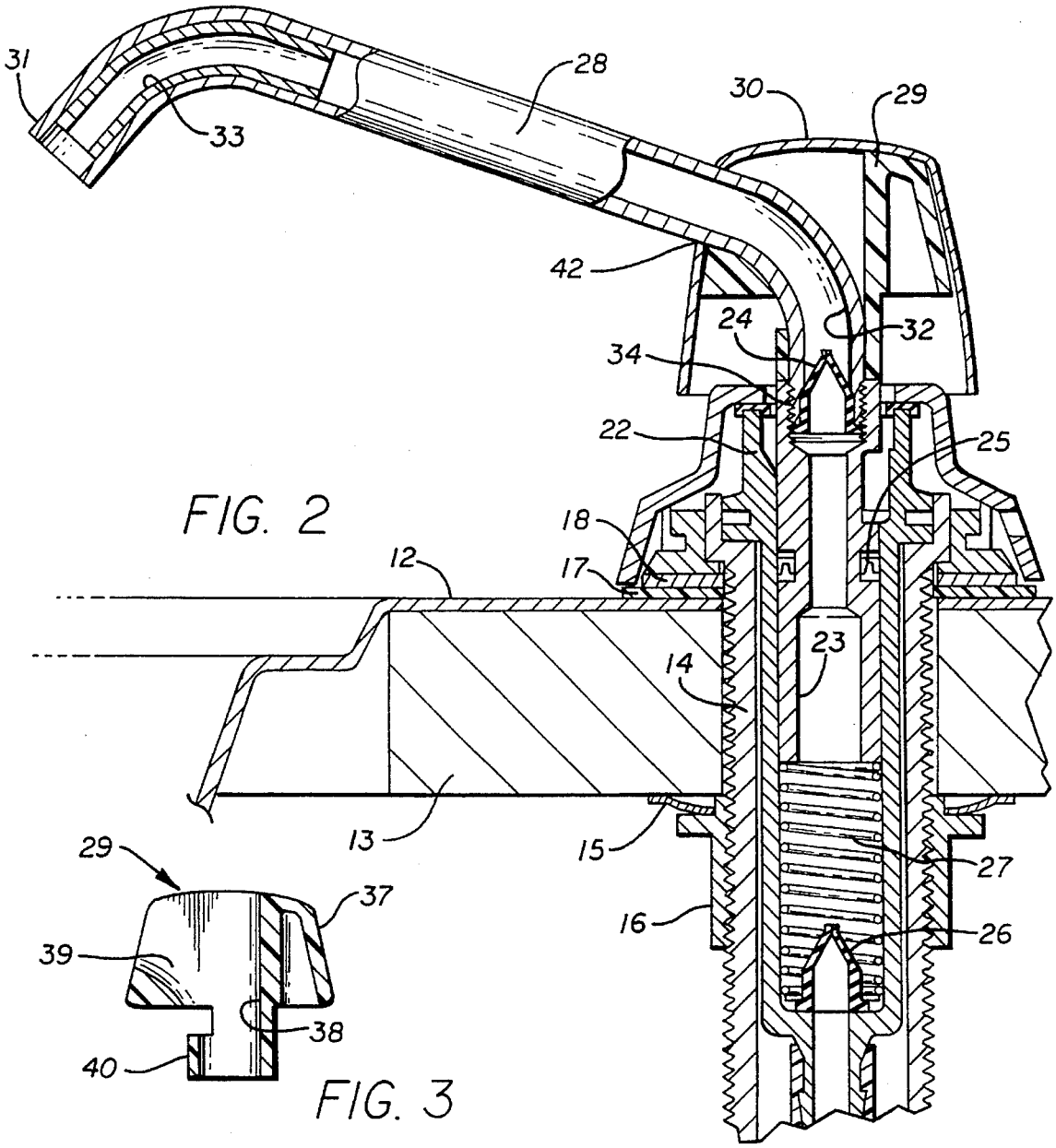
FIG. 2
FIG. 3

SPOUT ASSEMBLY FOR FLUID DISPENSER

BACKGROUND OF THE INVENTION

This invention relates to dispensers for fluids such as soaps and lotions, and in particular to a new and improved spout construction for such a fluid dispenser.

One type of prior art fluid dispenser includes a pump with a piston positioned for vertical movement, with a fluid container at the lower end and a pump actuating cap and outlet spout at the upper end. Fluid is dispensed by a downward push on the piston cap, pumping fluid upward through the piston and out through the spout.

This type of dispenser is mounted in a horizontal surface and the piston cap and spout are rotatable to position the outer end of the spout at a desired location. Specifically, the spout has a bend at the outer end for dispensing the fluid into the user's hand and therefore the outer end should bend downward. The inner end of the spout is straight and threaded into the piston. With such a design there is great difficulty in producing threads for the two components which exactly match so that the spout always rotates the same amount in the cap leaving the outer end directed downward for every spout and piston.

This problem has been handled in the past by threading a spout with a straight outer end into a piston cap until the threaded inner end of the spout stops in the threading opening in the cap. Then the outer end of the spout is bent in the desired downward direction. The spout can then be removed from the cap for various additional manufacturing and assembly steps. However, the specific spout and cap must be used together in the finished product so that the bend at the outer end of the spout is downward. This mode of construction is relatively expensive and there are always problems when the matched spout and cap become separated.

Accordingly, it is an object of the present invention to provide a new and improved fluid dispenser wherein the spout may be bent prior to any assembly and wherein any spout may be used with any piston cap while obtaining the desired position for the bend at the outer end of the spout.

Other objects, advantages, features and results will more fully appear in the course of the following description.

SUMMARY OF THE INVENTION

A fluid dispenser having a fluid container, a spout, and a pump for pumping fluid from the container out to the spout and having a piston for moving vertically along a piston axis, with the spout having an inner end connected to the piston through a piston cap, with downward pressure on the piston cap moving the piston downward and actuating the pump, wherein the spout has a center section, an outer end with an outer bend, and an inner end with an inner bend, the piston has an upper end, and the spout inner end and the piston upper end have interengaging threaded portions coaxial with the piston axis, and the piston cap has a body with a central opening coaxial with the piston axis and a lateral opening connecting with the central opening for receiving the spout, with the piston cap rotatable with the spout as the spout inner end is threaded into the piston upper end.

BRIEF DESCRIPTION OF THE DRAWING

FIG. 1 is a view of a wash basin with a fluid dispenser incorporating the presently preferred embodiment of the invention installed;

FIG. 2 is an enlarged partial sectional view of the dispenser of FIG. 1; and FIG. 3 is a sectional view of the piston cap of the dispenser.

DESCRIPTION OF THE PREFERRED EMBODIMENT

A typical fluid dispenser 11 is shown in FIG. 1 installed in a wash basin 12 on a counter 13. The dispenser includes a threaded mounting sleeve 14 with a lower gasket 15 and nut 16 and a upper gasket 17 and nut 18.

A pump is positioned inside the sleeve 14 and includes a cylinder 22 and piston 23, with an upper one way valve 24, a seal 25 and a lower one way valve 26. This construction is conventional, and a downward pressure on the upper end of the piston moves the piston axially downward compressing the spring 27 and forcing fluid upward through the center of the piston to an outlet spout 28.

The pump construction and operation and the installation of the dispenser are conventional. The new features of the present invention include the design and operation of the upper end of the piston, the piston cap 29, the shell 30 and the spout 28.

The spout 28 has an outer end 31 which is bent downward in the conventional shape, and an inner end 32 which is also bent downward. The center section of the spout may be straight as shown in FIG. 2 or may be curved. A conventional liner 33 may be inserted in the outer end of the spout to reduce dripping, if desired.

The upper end 34 of the piston is straight, and is internally threaded. The inner end 32 of the spout is externally threaded for engaging the upper end 34 of the piston.

The piston cap 29 has a body 37 with a central opening 38 coaxial with the axis of motion of the piston 23, and a lateral opening 39 in communication with the central opening 38. Preferably, the piston cap also has a depending sleeve 40 coaxial with the central opening 38. The spout 28 is installed on the dispenser by moving the inner end 32 of the spout in through the lateral opening 39 and down through the central opening 38, placing the threaded end of the spout into the threaded end of the piston, and rotating the spout and cap to engage the threaded portions. In the embodiment illustrated, the lower end of the sleeve 40 abuts against the upper end of the piston, with the extreme end of the spout inner end 32 clamping the upper valve 24 in place in the piston.

Typically, a shell 30 is positioned on the piston cap 29, with the lower end of the shell acting as a shroud to permit downward motion of the spout and piston cap. The shell 30 is provided with an opening 42 for passage of the spout. With this construction, the shell may be made a press fit on the piston cap, with the spout maintaining the shell in position on the piston cap.

The unique construction as described and illustrated permits the outer end of the spout to be bent, along with the inner end, prior to any assembly or trial assembly. The threaded engagement of the inner end of the spout with the piston provides engagement along the axis of the piston in alignment with the motion of the piston during pumping. This results in a coaxial pressure on the structure during fluid dispensing, in contrast with the oblique or eccentric pressure resulting from the prior art design. Also, in this unique construction the downward bend of the outer end of the spout is independent of the amount of the threaded engagement of the spout inner end with the piston. Any spout may be utilized with any piston, with the spout motion during assembly of the spout into the piston being rotational downward along the piston axis so that the spout outer end does not move away from its downward position.

The inner end 34 of the spout 28 is made a tight fit in the piston cap 29 and the shell 30. With this construction the piston cap and shell are held in position when the spout and piston upper end 34 are threaded together, thereby eliminating the need for gluing the shell on the cap in the prior design.

I claim:

1. In a fluid dispenser having a fluid container, a spout, and a pump for pumping fluid from the container out to the spout and having a piston for moving vertically along a piston axis, with the spout having an inner end connected to the piston through a piston cap, with downward pressure on the piston cap moving the piston downward and actuating the pump, the improvement wherein said pump has a first lower one-way valve below said piston and a second upper one-way valve above said piston, said spout being rigid with a center section, an outer end with an outer bend, and an inner end with an inner bend, said piston has an upper end, and said spout inner end and said piston upper end have interengaging threaded portions coaxial with said piston axis clamping said upper valve in place within said spout, and said piston cap has a body with a central opening coaxial with said piston axis and a lateral opening connecting with said central opening for receiving said spout, with said piston cap rotatable with said spout as said spout inner end is threaded into said piston upper end.

2. A dispenser as defined in claim 1 wherein said piston cap has a depending coaxial sleeve engaging said piston upper end about said spout inner end, with said piston cap body lateral opening and central opening each including means for slidingly receiving said spout inner end.

3. A dispenser as defined in claim 1 wherein said spout center section is straight.

4. In a fluid dispenser having a fluid container, a spout, and a pump for pumping fluid from the container out to the spout and having piston for moving vertically along a piston axis, with the spout having an inner end connected to the piston through a piston cap, with downward pressure on the piston cap moving the piston downward and actuating the pump, the improvement wherein said spout has a center section, an outer end with an outer bend, and an inner end with an inner bend, said piston has an upper end, and said spout inner end and said piston upper end have interengaging threaded portions coaxial with said piston axis, and said piston cap has a body with a central opening coaxial with said piston axis and a lateral opening connecting with said central opening for receiving said spout, with said piston cap rotatable with said spout as said spout inner end is threaded into said piston upper end, and including a shell positioned over and enclosing said piston cap, and including an opening in alignment with said piston cap lateral opening for receiving said spout.

5. A dispenser as defined in claim 4 wherein said piston cap has a depending coaxial sleeve engaging said piston upper end about said spout inner end.

6. A dispenser as defined in claim 5 with said spout inner end, said piston cap openings, and said shell opening tightly fitting together as a unit when said piston cap coaxial sleeve abuts said piston upper end.

* * * * *